United States Patent [19]

Edwards

[11] Patent Number: 4,785,229

[45] Date of Patent: Nov. 15, 1988

[54] THRESHOLD DETECTING BATTERY PROTECTION CIRCUITRY

[75] Inventor: David W. Edwards, Scottsdale, Ariz.

[73] Assignee: Motorola, Inc., Schaumburg, Ill.

[21] Appl. No.: 178,409

[22] Filed: Apr. 6, 1988

[51] Int. Cl.[4] ..... G05F 1/569

[52] U.S. Cl. ..... 323/284; 323/283; 307/39

[58] Field of Search ..... 323/282, 283, 284, 285; 363/20, 21; 307/38, 39; 361/18, 93

[56] References Cited

U.S. PATENT DOCUMENTS 3,988,643 10/1976 Morris ..... 323/285 X
4,314,198 2/1982 Rogers ..... 323/283 X
4,516,168 5/1985 Hicks ..... 363/56 X

*Primary Examiner*—Patrick R. Salce
*Assistant Examiner*—Kristine Peckman
*Attorney, Agent, or Firm*—Maurice J. Jones

[57] ABSTRACT

A power shutdown circuit includes an electronic latch circuit connected in series with a monitored power supply and comparator input and power terminals. The output terminal of the comparator is coupled to the control terminal of the latch. When a monitored signal magnitude crosses a threshold, the comparator provides a control signal which renders the latch nonconductive. A main switch device also connected to an output of the latch responds to the nonconductive state thereof to remove power from an electrical load.

12 Claims, 2 Drawing Sheets

THRESHOLD DETECTING BATTERY PROTECTION CIRCUITRY

BACKGROUND OF THE INVENTION

This invention relates to threshold detection circuitry and more particularly to such circuitry for use in shutting down the electrical power drawn by battery-operated equipment.

There is a need for circuitry which will sense and provide a control signal in response to a monitored signal magnitude falling below a predetermined threshold. More specifically, modern portable electronic equipment such as transceivers often are powered by rechargeable nickel-cadmium batteries or alternatively by lithium batteries which have long shelf lives. In many applications it is desirable that either of these type batteries be employable depending upon the particular circumstances. Unfortunately, lithium batteries tend to become explosive if operated beyond their capacity. The output voltage of both nickel-cadmium and lithium batteries tends to fall through a predictable threshold as these batteries become discharged. Hence, circuitry is required to sense when the lithium battery voltage falls below a threshold and to virtually disconnect the electrical loas from the battery. Furthermore, it is desirable that the threshold voltage at which shutdown occurs be readily adjustable and that the circuitry have a reset feature for enabling the immediate application of power after the battery has been changed and operation at reduced power levels after reset, for instance.

Prior art circuits for performing the foregoing or similar functions sometimes include mechanical relays which are too large, heavy and/or expensive to be utilized in compact, lightweight and inexpensive portable applications. Other prior art solutions require the use of expensive electrolytic capacitors.

Still other prior art solutions while providing power shutdown tend to continue to draw a leakage current after shutdown having an undesirably high magnitude which could have disastrous results in the case of lithium batteries. Moreover, some prior art solutions require an undesirable amount of operating current for portable applications.

While battery-powered equipment is being operated, the shutdown of a particular function such as ceasing transmission by a transceiver will result in an increase in the output voltage magnitude of a dangerously low battery. It is desirable that shutdown circuitry for use with lithium batteries include hysteresis which will continue shutdown of the electronic circuitry even though the magnitude of the battery voltage increases during the shutdown procedure. Some prior art shutdown circuits do not provide this hysteresis.

SUMMARY OF THE INVENTION

Accordingly, one object of the present invention is to provide circuitry which provides a control signal in response to a monitored signal crossing a predetermined threshold.

Another object of the present invention is to provide circuitry for electronically disconnecting a power source in response to the magnitude of a control signal provided by the power source crossing a predetermined threshold and to keep the power source disconnected even though the magnitude of the control signal crosses the threshold in the opposite direction during the shutdown procedure.

Yet another object of the present invention is to provide power shutdown circuitry which draws a minimal amount of leakage current from the power source when in the shutdown mode and which also draws a minimal amount of operating current during the monitoring mode.

A still further object of the invention is to provide solid state circuitry for performing a monitoring and shutdown function, which is lightweight, compact and inexpensive to manufacture and which operates over a wide temperature range.

An additional object of the present invention is to provide power shutdown in response to a monitored voltage crossing a threshold level that can be adjusted and which provides a reset feature enabling continuation of operation in response to he manual operation of a switch.

A particular embodiment of the present invention includes a power control circuit which provides a shutdown signal in response to the magnitude of a monitored signal crossing a predetermined threshold. The power control circuit includes a comparator which switches the state of the output signal thereof to provide the shutdown signal in response to the magnitude of a signal on one of its input terminals crossing a threshold level applied to another of its input terminals. A threshold level circuit is connected to one of the comparator input terminals of the comparator for providing the threshold. A latch circuit, which has a conductive and a nonconductive state, has a main terminal for receiving the monitored signal. A first circuit couples the other main terminal of the latch circuit to the other input terminal of the comparator thereby providing a control signal to the comparator having a magnitude that varies with the magnitude of the monitored signal when the latch is conductive. Another circuit couples the output terminal of the comparator to a control terminal of the latch. The comparator thereby renders the latch circuitry nonconductive in response to the shutdown signal provided by the comparator. A main switch has a control electrode coupled to said latch and a main electrode connected in series with the electrical load. The main switch disconnects the electrical load in response to the latch being rendered nonconductive.

BRIEF DESCRIPTION OF THE DRAWINGS

A more complete understanding of the present invention may be derived by reference to the detailed description and the claims when considered along with the accompanying drawings.

DETAILED DESCRIPTION OF THE PREFERED EMBODIMENT

Figure 1:
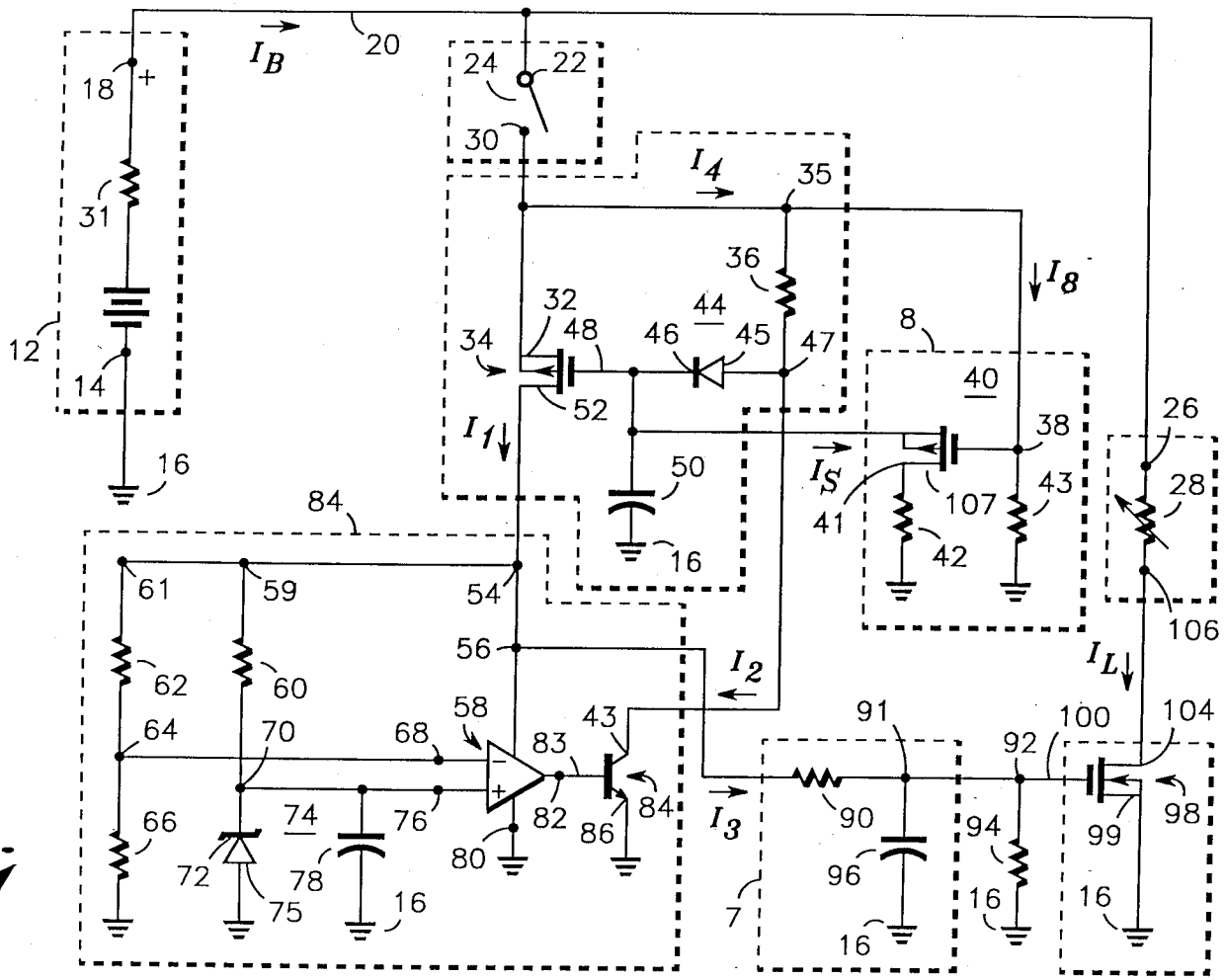
FIG. 1 is a schematic diagram of a power shutdown circuit in accordance with the invention.

Referring now to the drawings, FIG. 1 is a schematic diagram showing monitoring, power shutdown and automatic reset circuitry 10 which is coupled to battery 12 which may be either a lithium or a nickel-cadmium type. Battery 12 includes a negative terminal 14 which is connected to ground or reference potential conductor 16. Positive terminal 18 of battery 12 is connected via conductor 20 to terminal 22 of manual single-pole, single-throw ON-OFF switch 24 and to positive terminal 26 of an electrical load 28 which may be in the form of a transceiver or other electronic circuitry to be powered by battery 12. Resistor 31 represents the internal resistance of battery 12.

Switch 24 further includes terminal 30 which is connected to source electrode 32 of latch P channel enhancement FET 34, terminal 35 of resistor 36 and gate electrode 38 of P channel enhancement reset FET 40. Drain electrode 41 of FET 40 is connected through resistor 42 to reference potential conductor 16. Resistor 43 connects gate electrode 38 of FET 40 to reference conductor 16.

Diode 44 includes anode 45, connected to terminal 47 of resistor 36, and cathode 46 connected both to gate electrode 48 of FET 34 and through capacitor 50 to reference potential conductor 16. Drain electrode 52 of latch FET 34 is coupled through node 54 to power supply terminal 56 of comparator 58 and to terminals 59 and 61 of respective resistors 60 and 62. Resistor 62 is connected through node 64 in series with resistor 66 to form a voltage divider which samples the magnitude of the voltage of battery 12 when latch FET 34 is conductive. Node 64 is connected to the inverting input terminal 68 of comparator 58.

Resistor 60 is connected through node 70 to cathode electrode 72 of zener diode 74. Reference potential conductor 16 is connected to anode 75 of zener diode 74. Node 70 is connected to noninverting input terminal 76 of comparator 58 and through capacitor 78 to reference conductor 16. Terminal 68 and 76 are respectively inverting and non-inverting inputs with respect to collector electrode 43 of transistor 84. Comparator 58 further includes another power supply terminal 80 which is connected to reference conductor 16 and an output terminal 82 which is connected to base electrode 83 of NPN transistor 84. Transistor 84 further includes emitter electrode 86 which is connected to reference conductor 16 and collector electrode 43 which is connected to anode 45 of diode 44.

Power supply terminal 56 of comparator 58 is connected through resistor 90 which is connected to terminals 91 and 92. Resistor 94 is connected between terminal 92 and reference potential conductor 16. Delay capacitor 96 is connected in parallel with resistor 94 and between terminal 91 and reference potential conductor 16. N channel enhancement FET 98 includes source electrode 99 connected to reference conductor 16, gate electrode 100 which connected to terminal 92 and drain electrode 104 which is connected to terminal 106 of electrical load 28.

Figure 2:
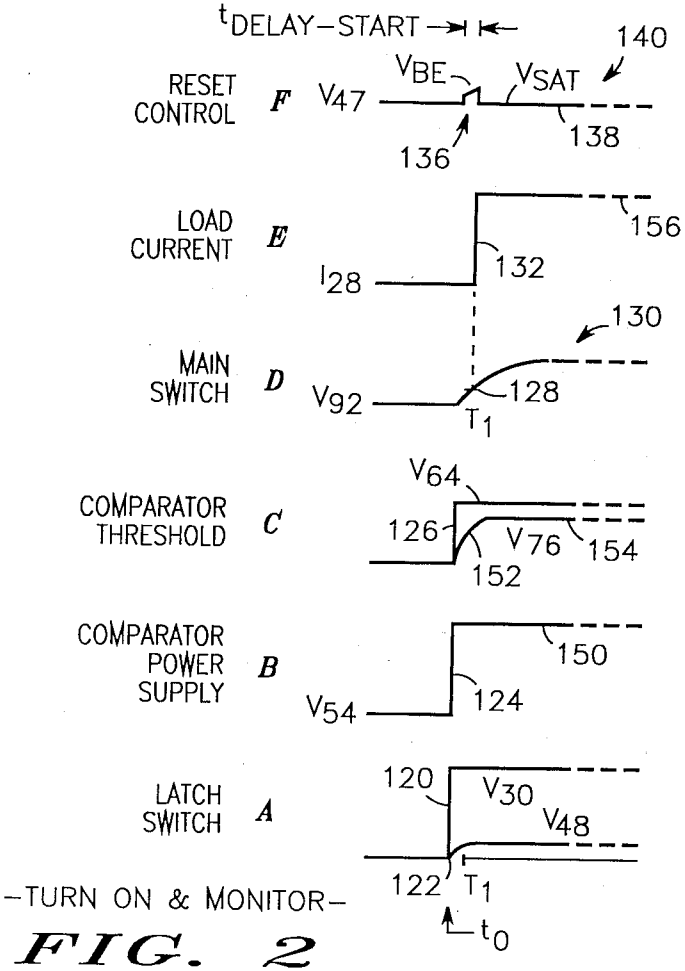
FIG. 2 is a timing diagram illustrating the operation of the turn on and monitoring functions of the circuit of FIG. 1.

FIG. 2A indicates waveforms at various terminals in circuit 10 during the turnon thereof and monitoring of the voltage of battery 12. More specifically, upon closure of switch 24 at time $T_0$, the voltage on terminal 18 of battery 12 is applied to switch terminal 30 thus driving the voltage on terminal 30, $V_{30}$, high as shown by waveform portion 120 of FIG. 2A. Consequently, FET 34 is rendered conductive because the voltage on gate 48 thereof, $V_{48}$ of FIG. 2A, is initially held to the ground or reference value by capacitor 50 as shown by waveform point 122 of FIG. 2A. Consequently, comparator supply voltage, $V_{54}$, is applied to terminal 54 of comparator 58 as indicated by waveform portion 124 of FIG. 2B. Also, the voltage divider including resistor 62 and 66 instantaneously provide a voltage at node 64, $V_{64}$, as indicated by waveform portion 126 of FIG. 2C. Capacitor 78 holds the voltage on comparator terminal 76 to a low magnitude during start up. Since the voltage on comparator input terminal 68 initially has a greater magnitude than the voltage on comparator input terminal 76, comparator 58 is rendered conductive and provides a positive voltage at output terminal 82 thereof which renders NPN transistor 84 conductive.

The comparator supply voltage, $V_{54}$, and current conducted by latch FET 34 at $T_0$ charges main switch delay capacitor 96 through resistor 90 to positive level 128 indicated on waveform 130 of FIG. 2D. As a result, main switch FET 98 is rendered conductive when level 128 of FIG. 2D is reached at time $T_1$ and load current $I_{28}$, then flows through load 28 as indicated by waveform portion 132 of FIG. 2E.

The voltage on node 47 of the latch circuit, $V_{47}$, rises from the VBE value of diode 44 at $T_0$ then drops to the saturation level of transistor 84 at a later time when transistor 84 is saturated, as indicated by respective portions 136 and 138 of waveform 140 of FIG. 2F.

Assuming that the monitored voltage magnitude on output terminal 18 of battery 12 remains at a satisfactory level, and under normal operation, circit 10 continues to operate with latch FET 34 conductive to provide the power supply voltage, $V_{54}$ to comparator 58 shown by waveform portion 150 of FIG. 2B. Current through resistor 60 renders zener 72 operative after the voltage $V_{76}$ across capacitor 78 rises above the zener level, as indicated by waveform 152 of FIG. 2C. Zener 74 clamps $V_{76}$ to threshold level 154 of FIG. 2C. As long as the magnitude of the battery voltage remains at a satisfactory level, the voltage on terminal 64 of the voltage divider, $V_{64}$ remains at a level above the zener voltage on comparator input terminal 76 and transistor 84 enables latch FET 34 to remain conductive thus keeping main FET switch transistor 98 conductive to sustain the load current $I_{28}$, as shown by waveform portion 156 of FIG. 2E. Reset FET 40 remains nonconductive during startup and monitoring conditions because the gate voltage on terminal 38 remains at a higher level than the voltage on source 41.

Figure 3:
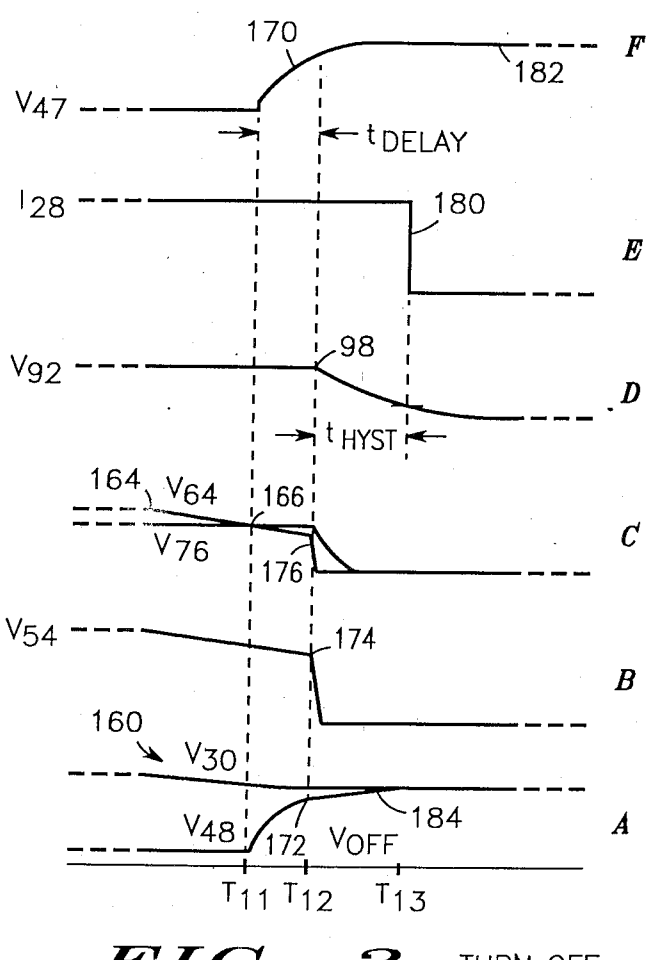
FIG. 3 is a timing diagram showing the turn off operation of the circuit of FIG. 1.

As battery 12 discharges, the magnitude of the voltage at output terminal 18 thereof and, hence, voltage $V_{30}$ tends to decrease in magnitude as indicated by waveform 160 of FIG. 3A. Consequently, $V_{54}$ at terminal 54 decreases in magnitude as shown by FIG. 3B thereby resulting in a reduction in the magnitude of the voltage on terminals 64 and 68, as indicated by waveform 164 of FIG. 3C. Eventually, the magnitude of voltage 64 crosses the zener threshold voltage on terminal 76 at time $T_{11}$ as indicated by point 166 of FIG. 3C. This condition indicates that the magnitude of the voltage of battery 12 is at an undersirably low level and that battery 12 should be disconnected. At time $T_{11}$, comparator 58 switches the output signal thereof at terminal 82 to a low level which renders transistor 84 nonconductive thereby diverting the current from node 47 through diode 44 to begin charging capacitor 50 as indicated by waveform portion 170 of the waveform of FIG. 3F. Eventually the voltage across capacitor 50 becomes sufficiently high at time $T_{12}$ to begin rendering latch FET 34 nonconductive as indicated by point 172 on the waveform for $V_{48}$ of FIG. 3A. Consequently, the comparator power supply voltage begins to drop at $T_{12}$ as indicated by the waveform for $V_{54}$ following point 174 of FIG. 3B. Moreover, the comparator threshold $V_{64}$ begins ramping rapidly downward at $T_{12}$ as shown by the portion of the $V_{64}$ waveform immediately following point 176 of FIG. 3C. As a result of latch transistor 34 discontinuing the delivery of current to node 91, hysteresis capacitor 96 begins discharging through resistor 94 thus tending to render main switch FET 98 nonconductive. At time $T_{13}$, transistor 98 is rendered completely nonconductive thereby causing the load currrent, $I_{28}$, to decrease to zero as indicated by waveform portion 180 of FIG. 3E.

Diode 44 continues to respond to $V_{30}$ to charge capacitor 50 to a high level as indicated by point 182 on the waveform of FIG. 3F to guarantee that latch FET 34 remains nonconductive as indicated by point 184 in FIG. 3A. It is possible for the magnitude of the output voltage of battery 12 to revive after shutdown begins at $T_{11}$. This can happen, for instance, because the value of load current 28 through battery resistance 31 is reduced because of switching of load 28 from a transmit to a receive mode in a transceiver. The reduced load current will reduce the voltage drop across internal battery resistance 31 thus increasing the voltage on terminal 18. Circuitry 10 insures that main switch FET 98 remains shutdown even though the rebounding voltage on terminal 18 pushes $V_{64}$ above $V_{76}$. This is because diode 34 prevents any resulting decision reversal of comparator 58 from causing the discharge of capacitor 50, which holds latch FET 34 in a nonconductive mode. Also, as the magnitude of $V_{54}$ rebounds, capacitor 78 holds up the comparator threshold voltage, $V_{76}$, assuring "below threshold" comparator decision which results in transistor 84 remaining nonconductive. The assured nonconductive level of transistor 84 tends to allow the charge of capacitor 50 beyond the original $V_{48}$ turnoff level of FET 34 which effects an "over-center" or hysteresis function.

Any rebound in a battery voltage due to load current reduction occurring long after latch FET 34 is fully off and non-resettable does not render transistor 98 conductive because of the action of capacitor 96. This delay action provides a time-based hysteresis. A predetermined time delay in the turnoff of main switch FET 98 is provided by capacitor 96.

The current supplied by battery 12 after dropout consists only of the small leakage currents of nonconductive latch FET 34, nonconductive reset FET 40, nonconductive main switch FET 98, comparator 58 and the current through resistor 43. The sum of these currents is less than the natural leakage of battery 12 and thereby insignificant to battery safety or conditioning.

If switch 22 is manually opened after a dropout, reset FET 40 is turned on since the voltage on terminal 30 of switch 24 falls to zero and the voltage on gate 38 is pulled to zero as a result of pulldown by resistor 43. Capacitor 50 then discharges through FET 40 and resistor 42. FET 40 does not interfere with normal operation of circuit 10 since the voltage on terminal 30 is the highest voltage in the circuit which assures that transistor 40 remains nonconductive during the monitoring operation.

It is possible to restart circuit 10 and operate at a low level after turnoff by opening switch 24 until FET 40 discharges capacitor 50 and then closing switch 24. Hence, a transceiver could be temporarily operated in the receive mode until battery 12 was again drained to the critical level. Similarly FET 40 automatically discharges capacitor 50 while battery 18 is disconnected during replacement.

Thus, it is apparent that power control circuit 10 fully satisfies the objects, the aims and advantages as set forth above. More specifically, circuit 10 provides a control signal on gate 100 of main FET switch 98 in response to the monitored battery magnitude on terminal 18 causing the voltage at comparator terminal 68 to cross the predetermined threshold provided by zener 74 at comparator terminal 76. Main switch FET 98 disconnects electrical load 29 from battery 18 by opening the connection to reference conductor 16 of terminal 106. Circuit 10 keeps battery 18 disconnected even though the magnitude of control signal on voltage divider terminal 64 later crosses the threshold provided by zener 74 in the opposite direction in response to the magnitude of battery voltage at terminal 18 increasing because of a reduction in load current, for instance. As described above, circuit 10 draws a minimal amount of leakage current from battery 12 when in the shutdown mode and circuit 10 also draws a minimal amount of operating current during the monitoring mode. Circuit 10 can be manufactured from solid state components which can be provided in a lightweight, compact and inexpensive package. Moreover, circuit 10 can operate over a wide temperature range, i.e. −30° C. to +55° C. Furthermore, the threshold levels can be adjusted by changing any of resistors 62 and 68 or zener 74.

While the invention has been described in conjunction with a specific embodiment thereof, it is evident that many alterations, modifications and variations will be apparent to those skilled in the art in light of the foregoing descriptions. Accordingly, the invention is intended to embrace all such alterations, modifications and variations in the appended claims.

I claim:

1. A power control circuit for providing a shutdown signal in response to the magnitude of a monitored signal provided by a power supply crossing a predetermined threshold level, the power control circuit including in combination:

comparator means having a first input terminal, a second input terminal and an output terminal;

threshold level means coupled to said first input terminal of said comparator means for providing the predetermined threshold level thereto;

latch means having a first main terminal, a second main terminal and a control terminal, said first main terminal being coupled to receive the monitored signal, said latch means having a conductive state and a nonconductive state;

first circuit means coupling said second main terminal of said latch means to said second input terminal of said comparator means, said first circuit means providing a first control signal to said second input terminal of said comparator means, said control signal having a magnitude that varies with the magnitude of the monitored signal;

second circuit means coupled between said output terminal of said comparator means and said control terminal of said latch means; and said comparator means switching the state of an output signal at said output terminal thereof to provide the shutdown signal in response to the magnitude of said control signal on said second input terminal of said comparator means crossing the predetermined threshold level applied to said first input terminal thereof, said second circuit means rendering said latch means nonconductive in response to said shutdown signal.

2. The power control circuit of claim 1 further including main switch means coupled to said second main terminal of said latch means, and said main switch means being rendered nonconductive in response to said latch means being rendered nonconductive by the shutdown signal provided by said comparator means.

3. The power control circuit of claim 1 wherein said comparator means further includes a power supply terminal coupled to said second main terminal of said latch means, and said comparator means being rendered inoperative in response to said latch means being rendered nonconductive and stopping power flow to said comparator means.

4. The power control circuit of claim 1 wherein said threshold level means includes a zener diode.

5. The power control circuit of claim 1 wherein said second circuit means further includes:

diode means having a first electrode and a second electrode, said first electrode of said diode means being coupled to said output terminal of said comparator means, and to the power supply, said second electrode of said diode means being coupled to said control terminal of said latch means; and capacitor means coupled to said second electrode of said diode means, said capacitor means being charged through said diode means by the power supply in response to said shutdown signal to hold said latch means in a nonconductive state even though said comparator means later switches the state of the output signal thereof.

6. The power control circuit of claim 5 further including:

reset circuit means coupled to said capacitor means and to the power supply; and switch means connected in series between the power supply and the reset circuit, said reset means discharging said capacitor means in response to the power supply being disconnected therefrom by manual operation of said switch means.

7. A control circuit for providing a shutdown signal for disconnecting a battery from an electrical load in response to the magnitude of the battery voltage crossing a predetermined threshold, the control circuit including in combination:

threshold level means for providing the predetermined threshold level at an output terminal thereof;

first transistor means having a first main electrode, a second main electrode and a control electrode, said first main electrode being coupled to the battery to receive the battery voltage;

comparator means having a first input terminal, a second input terminal and an output terminal, said first input terminal of said comparator means being connected to said output terminal of said threshold level means;

first circuit means coupling said second main terminal of said first transistor means to said second input terminal of said comparator means, said first circuit means providing a control signal having a magnitude that varies with the magnitude of the battery voltage;

second circuit means coupled between said output terminal of said comparator and said control terminal of said first transistor means; and said comparator means switching the state of an output signal at said output terminal thereof in response to the magnitude of the control signal applied to said second input terminal thereof crossing the predetermined threshold level applied to said first input terminal thereof to provide a power shutdown signal at said output terminal, said power shutdown signal rendering said first transistor means nonconductive;

second transistor means having a first main electrode, a second main electrode and a control electrode;

said main electrodes of said second transistor means be connected in series with the electrical load and the battery;

third circuit means coupling said control electrode of said second transistor means to said second main electrode of said first transistor means; and said second transistor means being rendered nonconductive to disconnect the battery from the electrical load in response to said first transistor means being rendered nonconductive by said power shutdown signal from said comparator means.

8. The control circuit of claim 7 wherein said comparator means further includes a power supply terminal coupled to aid second main electrode of said first transistor means, and said comparator means thereby being rendered inoperative in response to said first transistor means being rendered nonconductive.

9. The power control circuit of claim 7 wherein said threshold level means includes a zener diode.

10. The power control circuit of claim 7 wherein said third circuit means includes delay means.

11. The power control circuit of claim 7 wherein said second circuit means further includes:

third transistor means having a control electrode, a first main electrode and a second main electrode, said control electrode of said third transistor means being coupled to said output terminal of said comparator means;

diode means having a first electrode and a second electrode, said first electrode of said diode means being coupled to one of said main electrodes of said third transistor means and to the battery, said second electrode of said diode means being coupled to said control electrode of said first transistor means; and capacitor means coupled to said second electrode of said diode means, said capacitor means being charged through said diode means by the battery in response to said third transistor means being rendered nonconductive by said comparator means to thereby hold said latch means in a nonconductive state even though said comparator later switches the state of the output signal thereof.

12. The power control circuit of claim 11 further including:

a reference potential conductor;

fourth transistor means having a control electrode, a first main electrode and a second main electrode, said first main electrode being connected to said capacitor means, said control electrode being connected to receive the battery voltage, said second main electrode of said fourth transistor means being coupled to said reference potential conductor; and said fourth transistor means being rendered conductive in response to said battery voltage being disconnected therefrom to thereby discharge said capacitor means and reset the power control circuit.

* * * * *